US007947100B1

(12) United States Patent
Thomas et al.

(10) Patent No.: US 7,947,100 B1
(45) Date of Patent: May 24, 2011

(54) COMBINATION VERTICAL ROTARY VANE SUCTION PUMP AND LIQUID SEPARATOR

(75) Inventors: Delbert Thomas, Stevensville, MI (US); Christopher Lee Blackburn, St. Joseph, MI (US); Troy Smits, Benton Harbor, MI (US)

(73) Assignee: Gast Manufacturing, Inc., Benton Harbor, MI (US)

( * ) Notice: Subject to any disclaimer, the term of this patent is extended or adjusted under 35 U.S.C. 154(b) by 48 days.

(21) Appl. No.: 12/637,853

(22) Filed: Dec. 15, 2009

(51) Int. Cl.
*B01D 46/18* (2006.01)

(52) U.S. Cl. ..... 55/406; 55/407; 55/408; 55/467; 55/470; 55/471; 55/473; 96/196; 96/216; 96/217; 96/380; 95/261; 95/270; 210/416.1; 210/512.1; 210/532.1; 210/533

(58) Field of Classification Search ..... 55/406–408, 55/467, 470, 471, 473, 435; 96/196, 216, 96/217, 380; 95/261, 270; 210/416.1, 512.1, 210/532.1, 533
See application file for complete search history.

(56) References Cited

U.S. PATENT DOCUMENTS

| | | | | |
|---|---|---|---|---|
| 1,484,505 | A | 2/1924 | Kiefer | |
| 2,406,214 | A | 8/1946 | Garnier | |
| 3,002,523 | A | 10/1961 | Rabbits | |
| 3,051,175 | A | 8/1962 | Nugent | |
| 3,286,444 | A | 11/1966 | Boswinkle et al. | |
| 3,305,927 | A | 2/1967 | Mitchell | |
| 3,355,862 | A | 12/1967 | Blanchet et al. | |
| 4,293,300 | A | 10/1981 | Cattani | |
| 4,564,374 | A * | 1/1986 | Hofmann | 95/24 |
| 4,580,978 | A | 4/1986 | Motola et al. | |
| 4,684,345 | A | 8/1987 | Cattani | |
| 4,823,428 | A | 4/1989 | Sevigny | |
| 5,282,744 | A | 2/1994 | Meyer | |
| 5,548,944 | A | 8/1996 | Prochut et al. | |
| 5,618,410 | A | 4/1997 | Wallace et al. | |
| 5,738,519 | A | 4/1998 | Tenniswood | |
| 5,967,780 | A | 10/1999 | Morrissey | |
| 6,083,306 | A | 7/2000 | Cattani | |
| 6,146,136 | A | 11/2000 | Tenniswood | |
| 6,409,803 | B1 * | 6/2002 | Tremel et al. | 95/271 |
| 6,425,943 | B1 * | 7/2002 | Moredock | 95/269 |
| 6,638,066 | B2 | 10/2003 | Hubner et al. | |
| 6,752,857 | B1 * | 6/2004 | Birdwell | 95/270 |
| 6,770,109 | B2 * | 8/2004 | Tanaka et al. | 55/385.6 |
| 6,776,823 | B2 | 8/2004 | Hotta et al. | |
| 6,790,346 | B2 * | 9/2004 | Caleffi | 210/136 |
| 7,156,896 | B2 | 1/2007 | Schenk et al. | |
| 7,306,460 | B2 | 12/2007 | Hubner et al. | |
| 7,597,732 | B2 * | 10/2009 | Yokota et al. | 55/406 |
| RE41,212 | E * | 4/2010 | Lavasser et al. | 55/406 |
| 2002/0139249 | A1 * | 10/2002 | Livingston et al. | 95/270 |
| 2004/0103784 | A1 * | 6/2004 | Birdwell | 95/270 |
| 2006/0064954 | A1 * | 3/2006 | Yokota et al. | 55/406 |
| 2007/0221061 | A1 * | 9/2007 | Steiner et al. | 96/63 |
| 2007/0249479 | A1 * | 10/2007 | Eliasson et al. | 494/43 |

* cited by examiner

*Primary Examiner* — Jason M Greene
*Assistant Examiner* — Dung Bui
(74) *Attorney, Agent, or Firm* — Miller, Matthias & Hull LLP

(57) ABSTRACT

A compact suction and separation device is shown and described. The suction and separation device includes a pump and a separator. The pump includes a vertically oriented rotary vane pump comprising a suction inlet and an exhaust outlet. The separator includes a collector configured to receive combinations of solids, liquids and air. The separator separates solids and/or liquids from the air. Air from the separator is routed from an air discharge into the suction inlet of the pump. Solids and/or liquids are drained from a liquids/solids discharge of the separator. The separator may be gravity-based or centrifuge-type separator driven by the pump motor.

20 Claims, 12 Drawing Sheets

31
29
10
11
28
24
32
38
19
39
13
27
17
25
51
18
26
12
46
45
52
52

COMBINATION VERTICAL ROTARY VANE SUCTION PUMP AND LIQUID SEPARATOR

BACKGROUND

1. Technical Field

Compact combination suction devices and liquid separators are disclosed. More particularly, vertical rotary vane pumps are combined with a liquid/air separator using a single motor for providing both suction and liquid/air separation in a compact design. The disclosed combination vertical rotary vane pumps and liquid separators are ideal for use in dental offices, which typically have limited amounts of space available for such equipment.

2. Description of the Related Art

Suction tools and devices are commonly used in operating rooms, dental offices, and the like, to quickly clear excess liquids during medical procedures. For instance, a typical dental office may require a suction device to remove liquids and/or debris from the mouth of a patient while examining the patient's teeth or undergoing a particular procedure in the patient's mouth. Upstream of the suction device is a separator which is used to separate the liquid and solids removed from the patient's mouth before the air flow enters the suction device. Various centrifugal and tank base separators are known.

A typical suction device comprises a pump which compresses air and creates a vacuum or suction. A vacuum may be formed using commonly known pump and/or blower systems, such as liquid ring pumps, rotary vane pumps, blower-based systems, claw systems, and the like. Although these pumps provide adequate suction and performance, they still have their setbacks.

A liquid ring pump comprises a vaned impeller which rotates within a cylindrical housing while a liquid, such as water, is continuously fed into the cylindrical pump casing. As the impeller rotates, centrifugal forces cause the liquid to form a rotating cylindrical ring against the inner wall of the cylindrical housing. This liquid ring forms a series of sealed chambers with the impeller vanes to compress air. Liquid ring pumps are one of the more commonly used vacuum pumps installed in dental offices. This is because liquid ring pumps are reliable and compact in size. However, liquid ring pumps need a constant supply of water to create the sealed compression chambers. This demand for a constant supply of water results in significant water utility fees to the end user, inability to comply with local water conservation measures and other environmental concerns.

One alternative to using water consuming liquid ring pumps is to use rotary vane pumps. Rotary vane pumps employ a vaned rotor that is disposed within a cylindrical housing. The rotor and the cylindrical housing are axially misaligned or offset such that the rotor is never centered within the housing. The vanes are configured to be radially slidable with respect to the rotor and centrifugal forces bias the vanes radially outwardly to maintain contact with the inner wall of the housing. The vanes and the inner wall of the cylindrical housing form at least two sealed chambers. Compression is formed when the respective volumes of the sealed chambers increase and/or decrease as the off-centered rotor rotates. Although rotary vane pumps perform well without requiring a constant supply of water, they are larger than liquid ring pumps. Rotary vane pumps also need oil for lubrication, which raises additional environmental concerns.

Regenerative blowers can also be used to create a vacuum or suction for use with dental applications. Regenerative blowers include a multi-bladed impeller which rotates continuously. A small amount of air slips past one blade and returns to the base of a succeeding blade for reacceleration or "regeneration." Regenerative blowers do not require water or lubrication. However, regenerative blowers are large and use significantly more electricity than liquid ring pumps.

Claw systems employ rotating claw-shaped lobes which mesh with one another and form sealed chambers when fitted within the vacuum housing. Rotating the claw-shaped lobes varies the volumes of the respective chambers within the housing to create compression or suction. Claw systems do not require water or oil lubrication to maintain properly sealed compression chambers. However, claw systems are large and expensive.

Therefore, there is a need for an improved suction system that provides comparable or better performance while overcoming all of the deficiencies associated with the prior art. Because modern dental offices are operating on thin margins, capital costs and operating costs are primary concerns. Further, as dental offices attempt to operate more efficiently, dental offices are becoming smaller, thereby creating a demand for smaller suction and separator systems. As a result, there is a need for a cost efficient and compact suction device combined with a separator which creates at least as much compression or vacuum as liquid ring pumps without requiring water or oil lubrication and which conserves space.

While the following discussion will be directed toward suction and separation devices for use with dental applications, it will be noted that this application and the devices disclosed herein are applicable to various fields beyond that of suction and separation devices for use with dental applications, and more generally, can be applied to any application requiring solid and/or liquid suction.

SUMMARY OF THE DISCLOSURE

In satisfaction of the aforenoted needs, a compact suction and liquid separation device for use in dental and medical offices is disclosed.

One disclosed compact suction and liquid separation apparatus comprises a pump, a separator and a common motor, vertically stacked with respect to each other. The pump comprises a suction inlet and an exhaust outlet. The separator (i.e. an air/liquid-solids separator) comprises an inlet configured to receive air and liquids, an air discharge configured to route air from the separator to the suction inlet of the pump. The separator also comprises a liquids/solids discharge configured to drain liquids and solids from the separator. The motor is coupled to both the pump and separator.

In a refinement, the compact suction and separation apparatus comprises a noise-reducing enclosure.

In another refinement, the pump is disposed above the motor and the separator is disposed below the motor.

In another refinement, the pump comprises a vertically orientated rotary vane pump.

In another related refinement, the rotor of the vane pump is cantilevered or supported on only one side, the bottom side, of the rotor. As a result, an upper cap is removably coupled to an upper surface of the pump rotor and vanes to allow access to the vanes for servicing without needing to remove a bearing.

In another refinement, the air discharge is coupled to the suction inlet using tubing.

In another refinement, the rotary vane pump comprises a casing disposed between an upper cap and a head plate. The casing accommodates the pump rotor and a plurality of vanes slidably coupled to the pump rotor. The pump rotor is coaxially coupled to the drive shaft whereby an upper portion of the drive shaft and rotor are disposed within the pump casing but are offset from an axial center of the pump casing. The rotary vane pump is in a vertical orientation, whereby the vanes that are slidably coupled to the pump rotor extend radially outwardly from the drive shaft and pump rotor when the pump rotor is rotated within the casing. The rotor is supported by a bearing disposed below the rotor. To change the vanes, only the upper cap needs to be removed.

In a related refinement, the separator comprises a spinning disk separator that is driven by the motor.

In a refinement, the liquid separator comprises a separator rotor coupled to the motor by a drive shaft extending vertically downward from the motor.

In another refinement, the motor is coupled to a drive shaft that extends vertically upward to the pump and vertically downward to the liquid separator.

A compact combination suction and separation apparatus for use with dental procedures is disclosed. The apparatus comprises a vertically oriented rotary vane pump comprising a pump casing disposed between a removable upper cap and a lower head plate. The head plate comprises a suction inlet and an exhaust outlet in communication with the pump casing. The pump further comprises a pump rotor slidably coupled to a plurality of vanes. The apparatus further includes a liquid separator comprising a housing and a separator rotor. The separator housing is coupled to an inlet for receiving air, liquids and solids from a dental suction tool, an air discharge coupled to the suction inlet of the pump and a liquids/solids discharge. The apparatus further comprises a motor disposed between the pump and separator. The motor is coupled to a vertical drive shaft that extends upward into the pump casing and that is coupled to the pump rotor. The drive shaft also extends downward into the separator housing and is coupled to the separator rotor.

In a refinement, the pump casing has a vertical axis and the drive shaft, pump rotor, separator rotor and separator housing have a common vertical axis offset from the vertical axis of the pump casing.

As shown below, the vane pump, motor and separator are all in generally axial alignment with each other to conserve floor space.

In another refinement, a rotary vane pump can be combined with a gravity-based liquid separator. One disclosed liquid separator includes an inlet disposed between upper and lower chambers. A flapper valve or baffle separates the chambers. A solenoid valve or other suitable valve may be connected to the upper chamber and the lower chamber is connected to a bottom reservoir. The bottom reservoir includes an upper level switch and a lower level switch.

In operation, the rotary vane pump runs continuously and therefore the upper chamber is under vacuum. With the solenoid in a closed position, the upper chamber is isolated from the atmosphere the pressures in the upper and lower chambers is equalized. Air/fluids/solids will enter the upper chamber through the inlet and the fluids/solids will drain downward to the lower chamber under the force of gravity. Material will eventually pass downward to the bottom reservoir. When the upper level switch of the bottom reservoir is activated, the system needs to be drained and the solenoid is opened thereby creating pressure in the upper chamber and closing the flapper or baffle. With the lower chamber and bottom reservoir isolated from the vacuum of the rotary vane pump, material may exit the system through a check valve.

Other advantages and features will be apparent from the following detailed description when read in conjunction with the attached drawings.

BRIEF DESCRIPTION OF THE DRAWINGS

The disclosed suction devices are described more or less diagrammatically in the accompanying drawings wherein.

It should be understood that the drawings are not necessarily to scale and that the embodiments are sometimes illustrated by graphic symbols, phantom lines, diagrammatic representations and fragmentary views. In certain instances, details which are not necessary for an understanding of this disclosure or which render other details difficult to perceive may have been omitted. It should be understood, of course, that this disclosure is not limited to the particular embodiments and methods illustrated herein.

DETAILED DESCRIPTION OF THE PRESENTLY PREFERRED EMBODIMENTS

Figure 1:
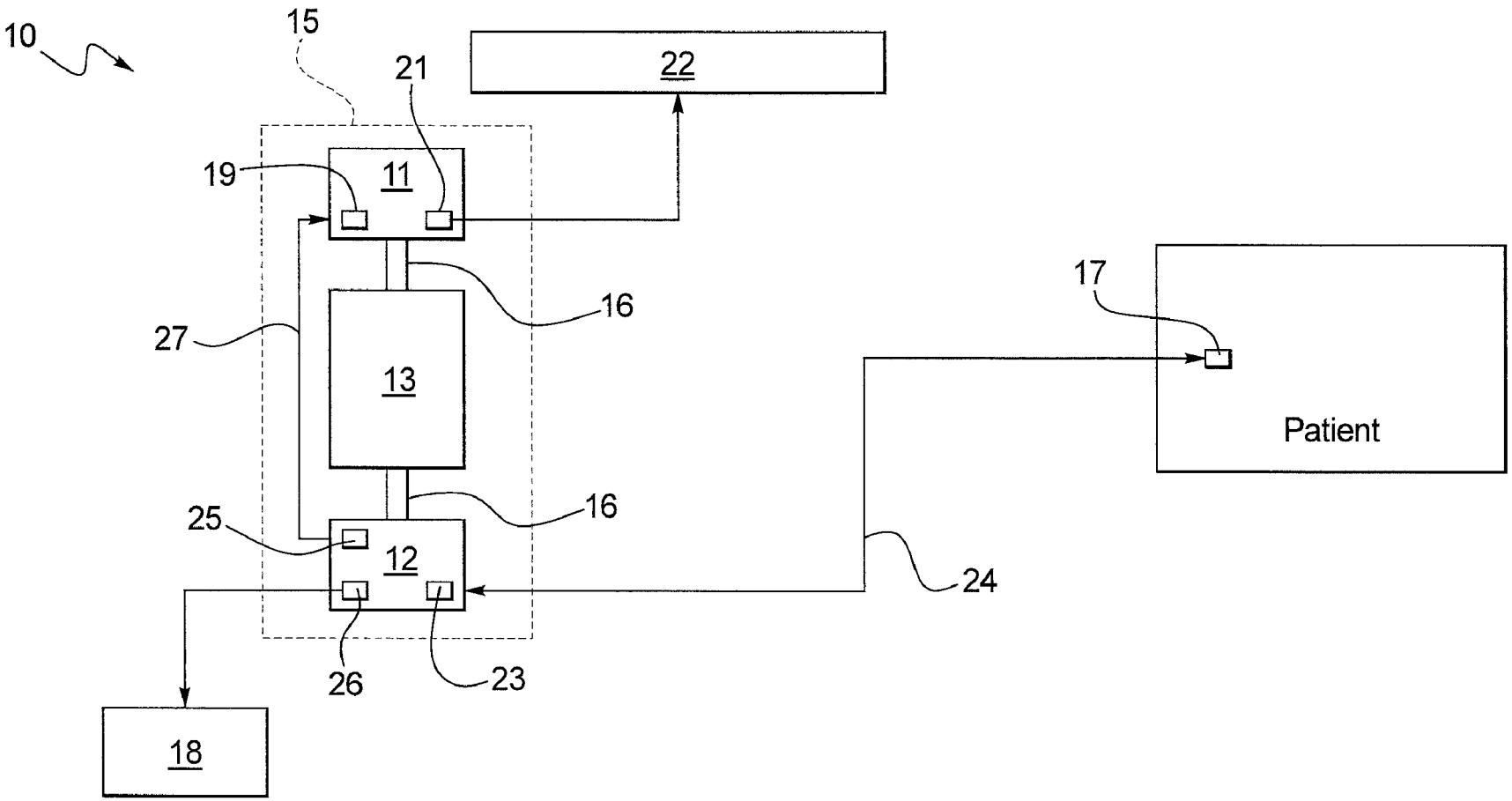
FIG. 1 is a diagram of a disclosed combination of suction and liquid separation apparatus.

FIG. 1 illustrates a diagrammatic view of a disclosed combination suction/liquid separator 10 as configured for use with a typical dental application. As shown in FIG. 1, the combination suction/liquid separator 10 may include a pump 11, a liquid separator 12 and a motor 13 for operating the pump 11 and the separator 12. The suction/liquid separator 10 may optionally include an enclosure 15 so as to reduce noise caused by operating the device 10. The pump 11 may comprise any pump or blower configuration commonly known in the art to create a vacuum or suction, for example, a rotary vane pump. The liquid separator 12 may be configured to be an automatic separator that uses gravity to passively separate solids and/or liquids from air or other gases. Alternatively, the liquid separator 12 may be configured to include a mechanical or spinning disk separator to actively separate solids and/or liquids from air. The motor 13 may be, for example, an induction motor, or any other motor appropriate for driving vacuum pumps or blowers. Optionally, the liquid separator 12 may be associated with a separate motor (not shown), but to conserve space and save cost, the motor 13 preferably drives the separator 12 and pump 11 with a common drive shaft 16. Suction within the liquid separator 12 may be used to receive any mixture of solids, liquids and air resulting from, for example, a dental suction tool 17. As the solid/liquid/air mixture reaches the liquid separator 12, solids and/or liquids are separated from the air and subsequently disposed of through the drain 18.

The pump 11 may include at least one suction inlet 19 and at least one exhaust outlet 21. If necessary, the exhaust 21 of the pump 11 may be routed to a vent 22, or the like, leading outdoors. The liquid separator 12 may include at least one inlet 23 and at least two outlets 25, 26. The inlet 23 of the liquid separator 12 may be configured to intake any combination of solids, liquids and air received through the suction tool 17, or the like, being used on a patient. The inlet 23 may be coupled to the suction tool 17 with an extended tube 24, or the like. An air discharge 25 of the liquid separator 12 may be configured to discharge air and a liquids/solids discharge 26 may be configured to discharge solids and/or liquids that have been separated from the air.

Operation of the pump 11 may create a vacuum or suction at the suction inlet 19, which may in turn create suction at the air discharge 25 of the liquid separator 12. The air discharge 25 of the separator 12 may be coupled directly to the suction inlet 19 of the pump 11 using a conduit or tubing 27. The liquids/solids discharge 26 of the liquid separator 12 may be routed directly into the waste drain 18, or the like, to dispose of any collected solids and/or liquids. The motor 13 comprises a drive shaft 16 coupled to the pump 11 and liquid separator 12.

Figure 2:
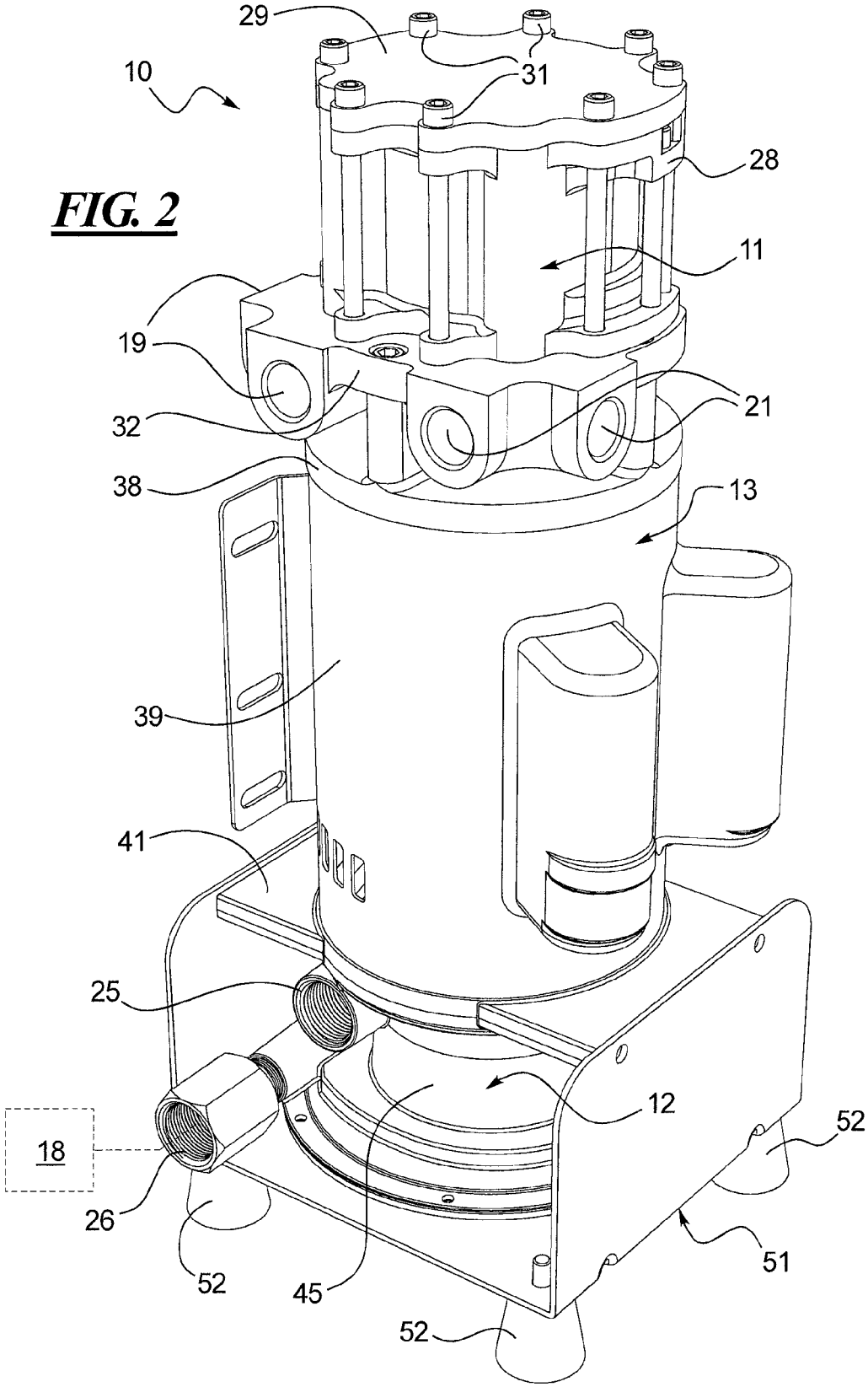
FIG. 2 is a perspective view of a disclosed combination suction and liquid separation apparatus.
Figure 3:
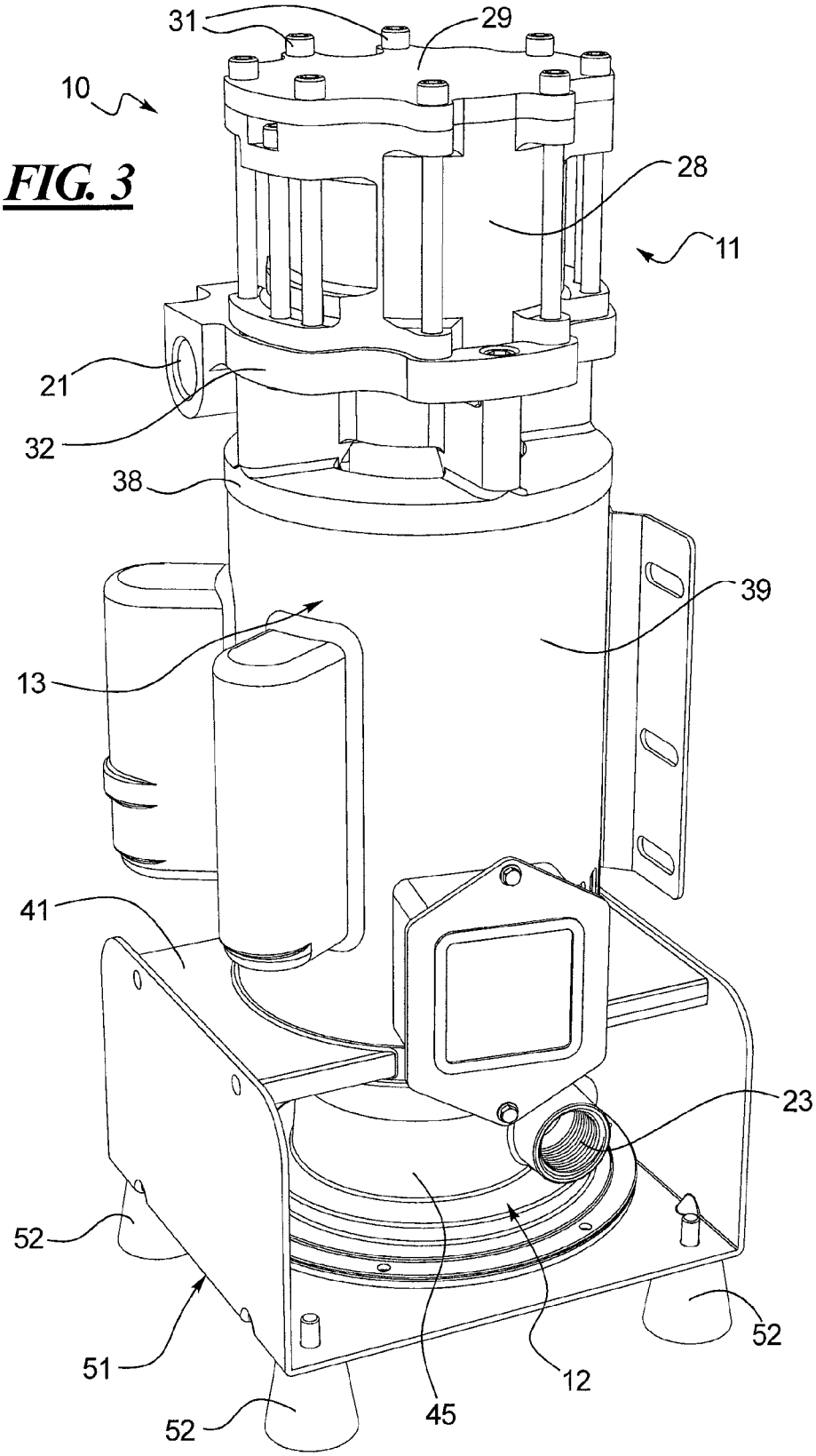
FIG. 3 is another perspective view of the apparatus shown in FIG. 2.

FIGS. 2-8 provide more detailed views of disclosed combination suction/liquid separator 10, pump 11, built-in liquid separator 12 and a motor 13. Referring first to FIGS. 2-3, the pump 11 may be disposed at an upper portion of the suction/liquid separator 10. The pump 11 may include a pump casing 28 and an upper cap 29 that is removably coupled to the pump casing 28 with a plurality of fasteners 31, or other types of fasteners. The pump 11 may be a rotary vane pump vertically oriented within the pump casing 28. The pump 11 may additionally include one or more suction inlets 19 as well as one or more exhaust outlets 21. The vertical orientation of the rotary vane pump 11 is significant in that it minimizes the footprint occupied by the suction/liquid separator 10, and further, ensures that the rotary vane pump 11 is never in contact with any of the solids and/or liquids being suctioned. Placing the vane pump 11 and upper cap 29 at the top of the apparatus 10 also makes it easier to access the pump 11 for service and maintenance.

Figure 4:
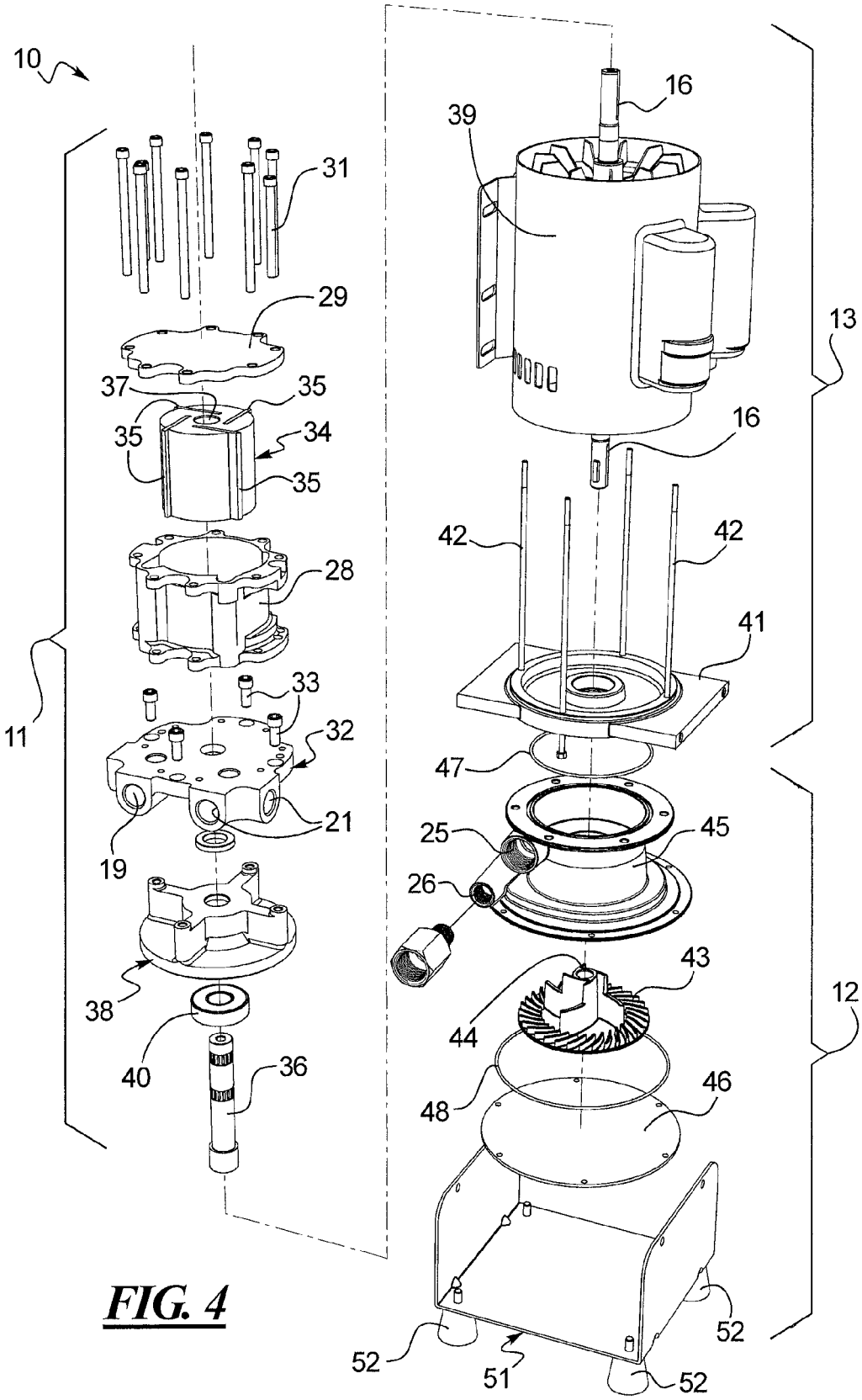
FIG. 4 is an exploded view of the apparatus shown in FIGS. 2-3.

Still referring to FIGS. 2-3, the liquid separator 12 is disposed below the motor 13 and opposite the motor 13 from the pump 11. The separator 12 may include a spinning disk or rotor mechanism, for separating solids and/or liquids from air. Alternatively, the liquid separator 12 may simply be configured as an automatic separator, such as a tank-in-tank separator, which employs gravity to passively separate solids and/or liquids from air. The liquid separator 12 as shown comprises an inlet 23 and two discharge outlets 25, 26 comprising an air discharge 25 coupled to the suction inlet 19 of the pump 11 and a liquids/solids discharge 26 connected to a drain or waste reservoir 18. Turning to FIG. 4, the fasteners 31 connect the upper cap 29 to the pump casing 28. The pump casing 28 is connected to a head plate 32 with the fasteners 33. The head plate 32 comprises the pump inlets 19 and exhaust outlets 21. Typically, only one of the two inlets 19 and only one of the two exhausts 21 are used at a time. A rotor 34 with a plurality of sliding vanes 35 is sandwiched between the cap 29 and head plate 32 within the pump casing 28. A bearing plate 38 is disposed below the head plate 32 and accommodates a bearing 40 and rotor shaft 36. The rotor shaft 36 is coupled to the motor drive shaft 16 with a tongue-in-groove connection, splined connection or other type of connection known to those skilled in the art. The rotor shaft 36 is frictionally coupled to the rotor 34 within the axial opening 37 of the rotor 34. The axial opening 37 may be round as indicated in FIGS. 4 and 6 or maybe oval-shaped.

Still referring to FIG. 4, the motor 13 comprises an outer housing 39 and a base plate 41 that is connected to the bearing plate 38 with the elongated fasteners or threaded rods 42. The lower end of the drive shaft 16 is coupled to the separator rotor 43 with a tongue-in groove connection, splined connection or similar connection in the axial opening 44 of the separator rotor 43. The separator 12 comprises a housing 45 that is sandwiched between the separator base plate 46 and the motor base plate 41. O-rings or seal elements are shown at 47, 48. The entire apparatus 10 rests on a supporting base 51 that may be supported above a floor level by footings 52.

A key advantage to the design of the pump 11 is illustrated in FIG. 4. Specifically, the bearing 40 and bearing plate 38 that support the rotation of the rotor 34 are disposed below the rotor 34 and beneath the head plate 32. This "cantilevered" design enables access to the vanes 35 by merely removing the upper plate 29.

Figure 5:
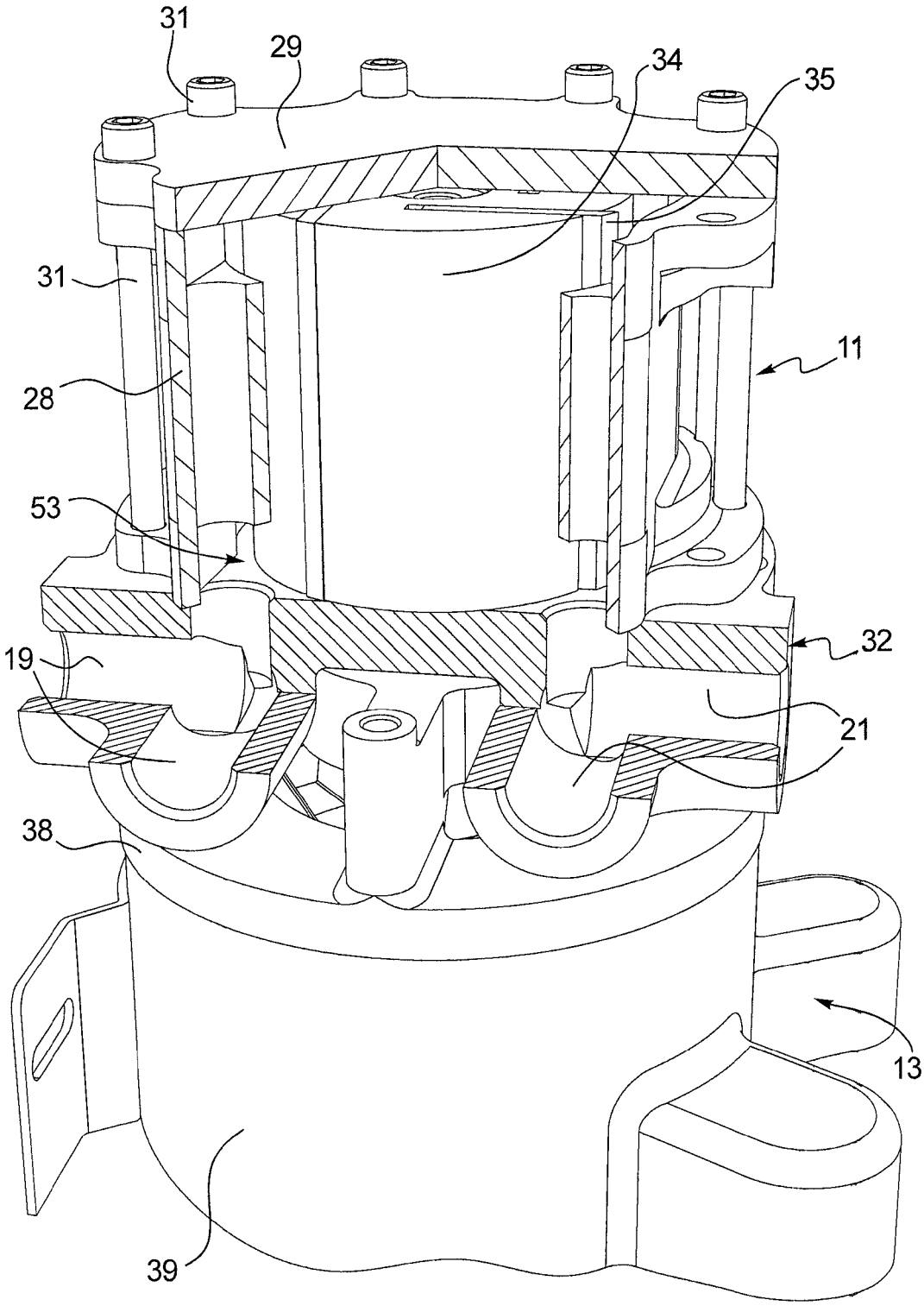
FIG. 5 is a partial perspective and sectional view of the apparatus illustrated in FIGS. 2-4, particularly illustrating the rotary vane pump.
Figure 6:
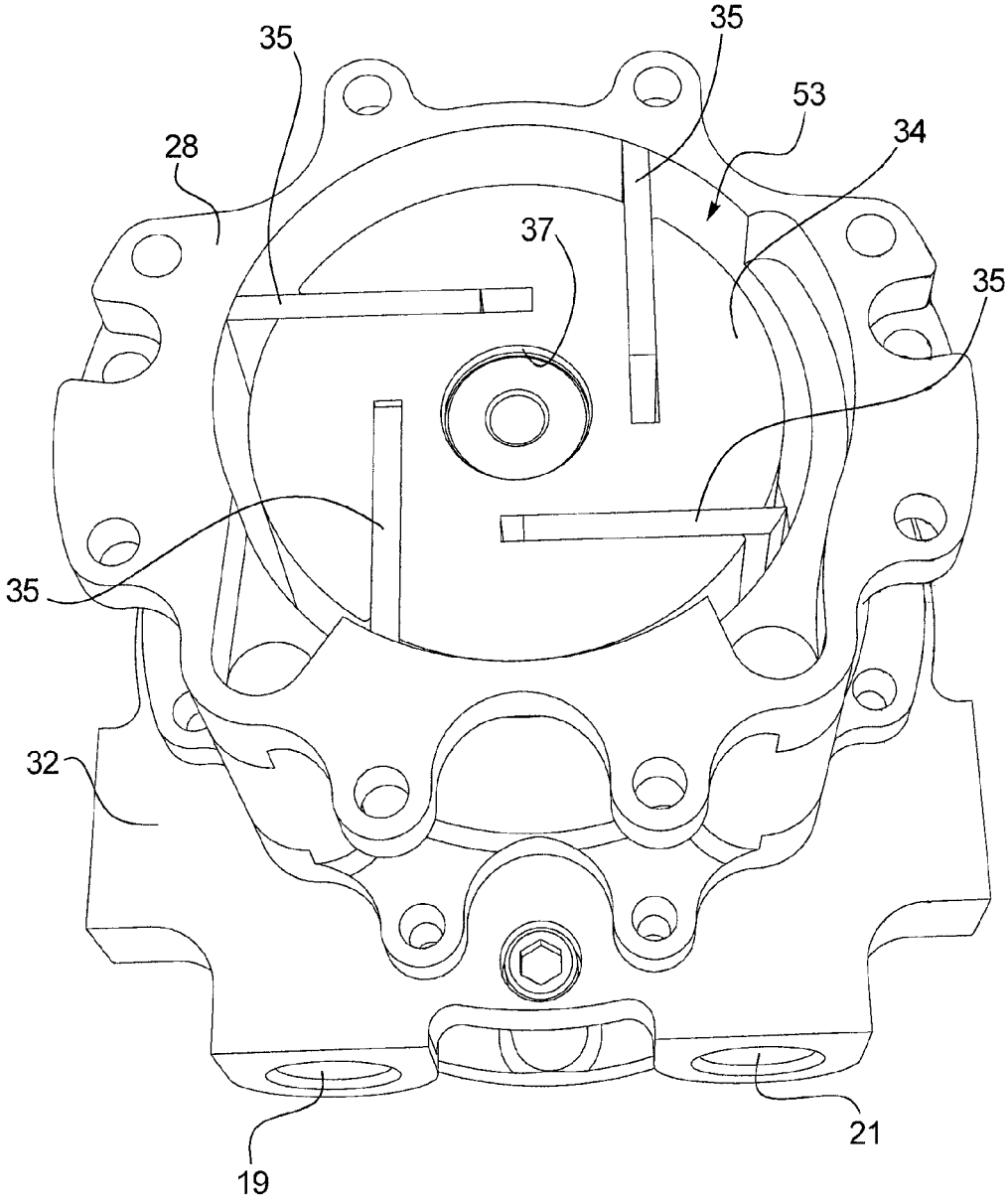
FIG. 6 is a top perspective view of the rotary vane pump of the apparatus illustrated in FIGS. 2-5, with the top cover or upper cap removed thereby exposing the rotor and vanes.

FIGS. 5-6 illustrate the position of the rotor 34 in the pump casing 28 and between the cap 29 and head plate 32. One of the vanes 35 is extended outward from the rotor 34 to engage an interior surface of the casing 28. FIG. 5 also illustrates communication between the suction inlets 19 and exhaust outlets 21 and the pump chamber 53 (FIG. 6) which may be defined by the cap 29, the casing 28 and the head plate 32. FIG. 6 illustrates one disclosed rotor 34, which, in this example, comprises four sliding vanes 35. The number of vanes 35 may vary as will be apparent to those skilled in the art.

Figure 7:
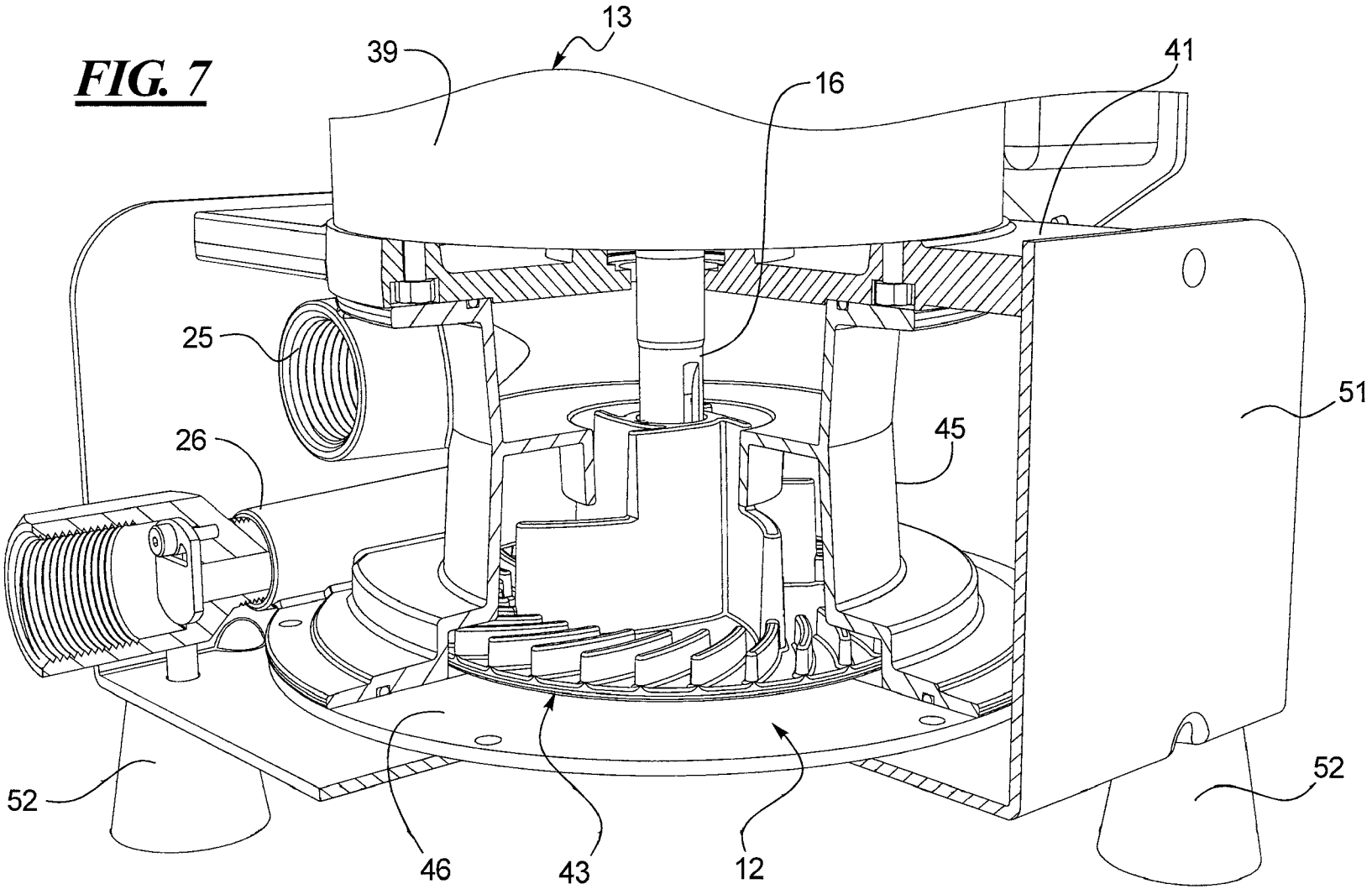
FIG. 7 is a partial perspective and sectional view of the apparatus illustrated in FIGS. 2-6, particularly illustrating the separator.
Figure 8:
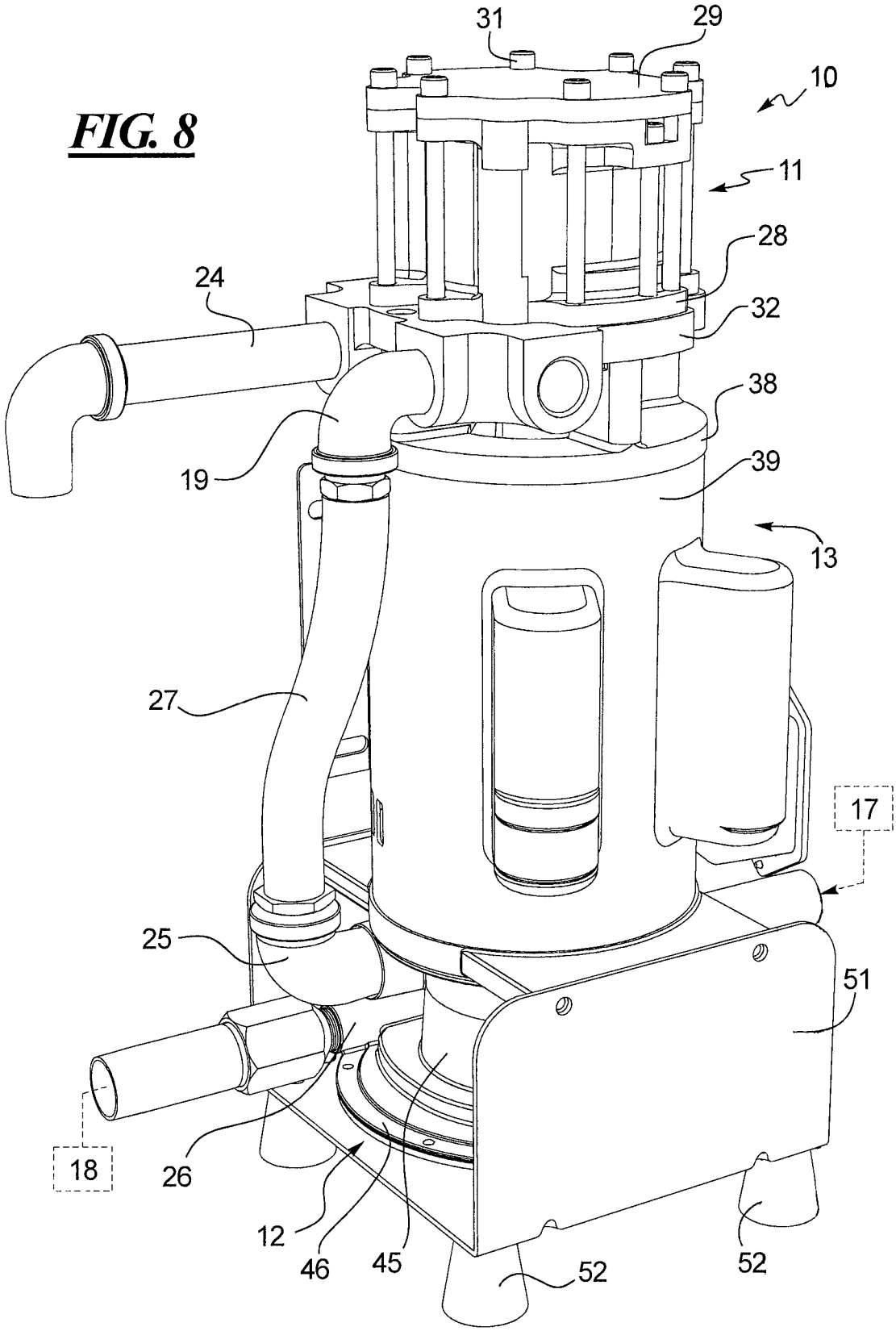
FIG. 8 is a perspective view of the apparatus illustrated in FIGS. 2-7, equipped with tubing that connects the separator air discharge and the pump suction inlet.
Figure 9:
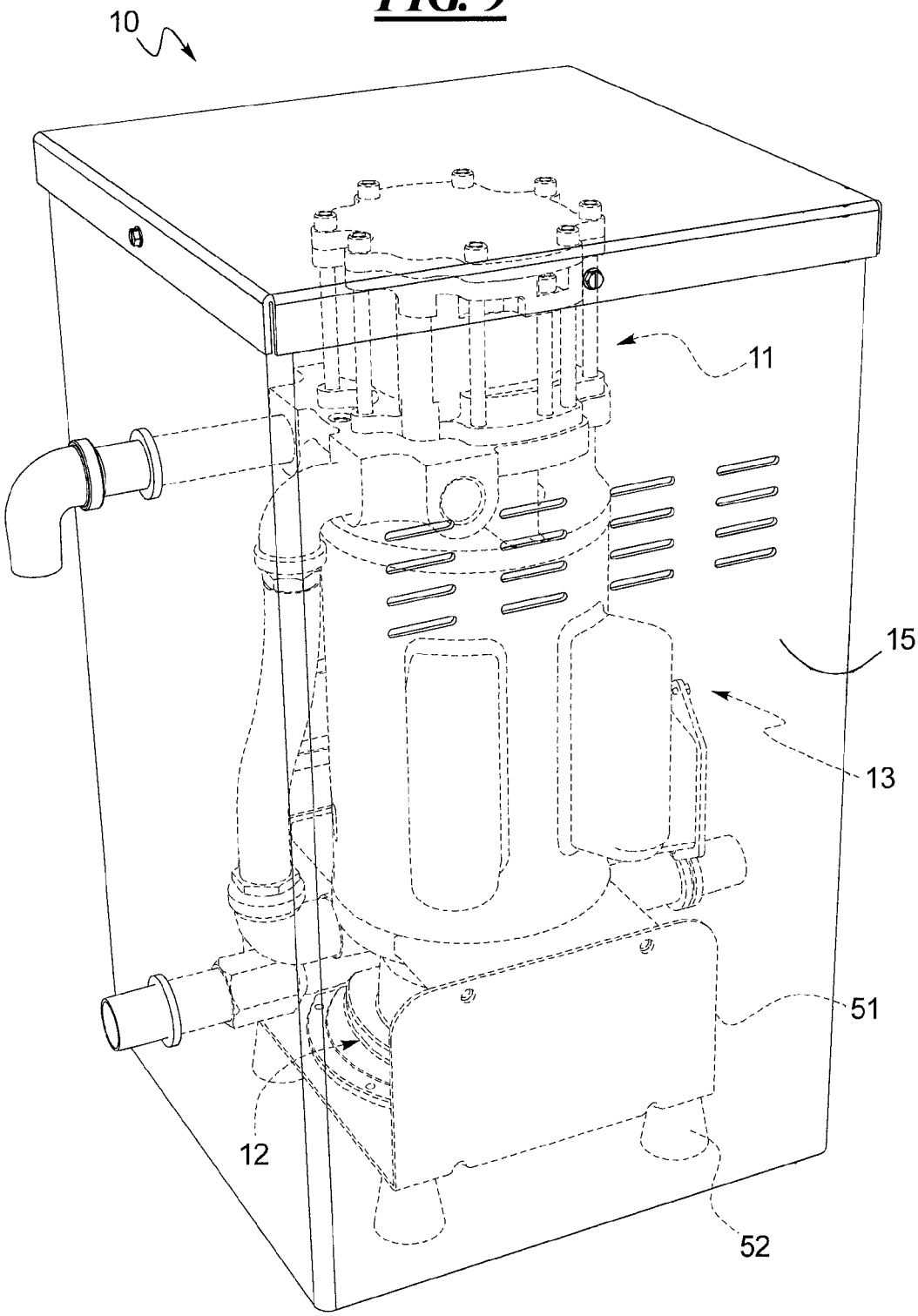
FIG. 9 is a perspective view of the apparatus illustrated in FIG. 8 and disposed within an outer enclosure for noise reduction.

FIG. 7 illustrates the connection between the separator rotor 43 and the motor drive shaft 16. FIG. 8 illustrates the tubing 27 connecting the separator air discharge 25 to the pump suction inlet 19. FIG. 9 illustrates one example of a noise reducing enclosure 15 for the apparatus 10.

Once power is supplied to the combination suction/liquid separator 10, the motor 13 rotates the drive shaft 16 and consequently the rotors 34, 43 of the pump 11 and separator 12 respectively. Any solids and/or liquids that have entered the liquid separator 12 from the suction tool 17 (FIGS. 1 and 8) are separated from the air by the spinning rotor 43. The air is routed to the suction inlet 19 of the pump 11 while solids and/or liquids are dispensed to the waste drain 18 (FIGS. 1 and 8) through the liquids/solids discharge 26. The suction provided by the pump 11 creates a vacuum in the separator 12 as well as at the dental tool 17.

Figure 10:
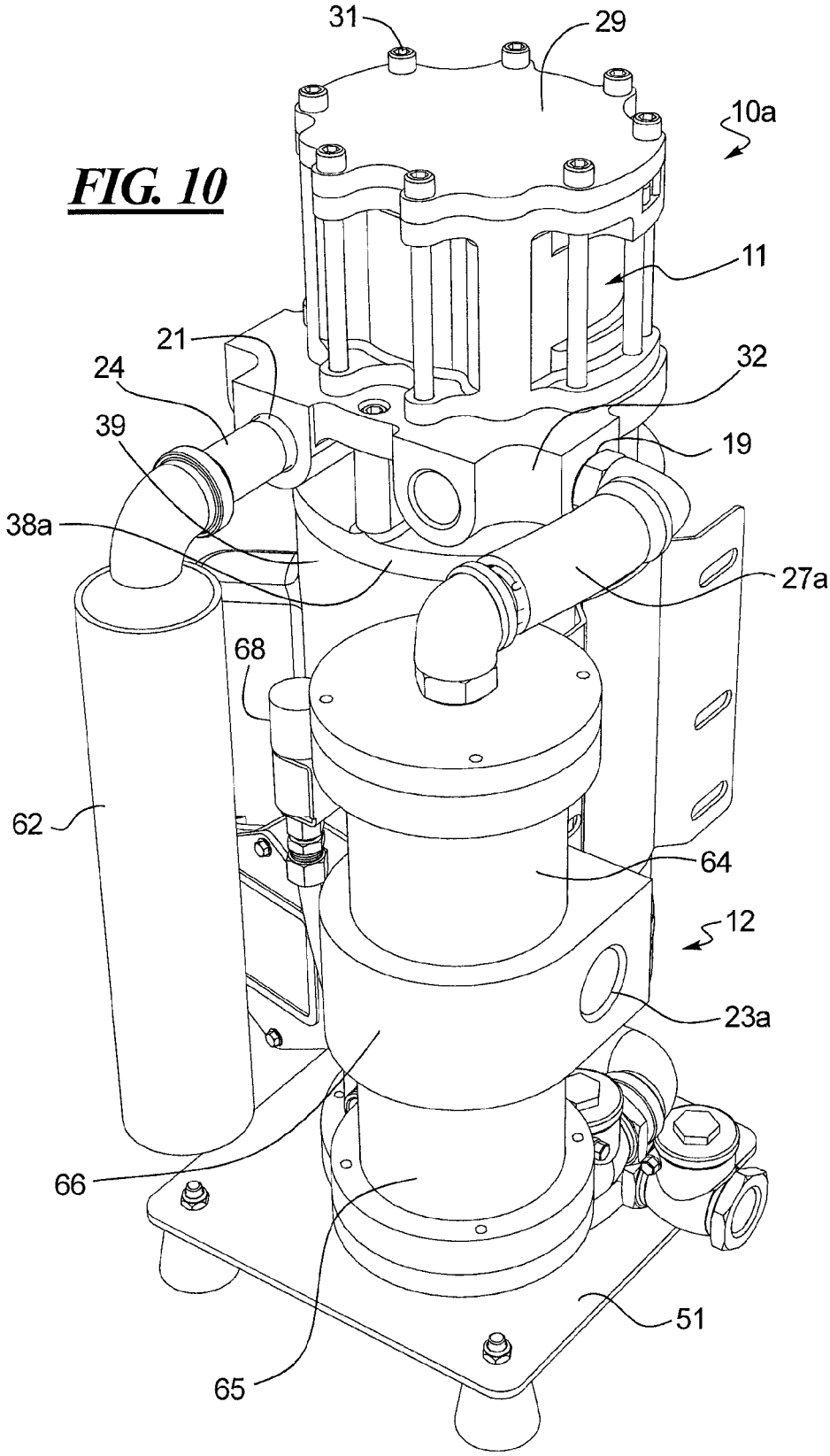
FIG. 10 is a perspective view of another combination vertical rotary vane suction pump and liquid separator, wherein the liquid separator is gravity-based as opposed to centrifugal-based.
Figure 11:
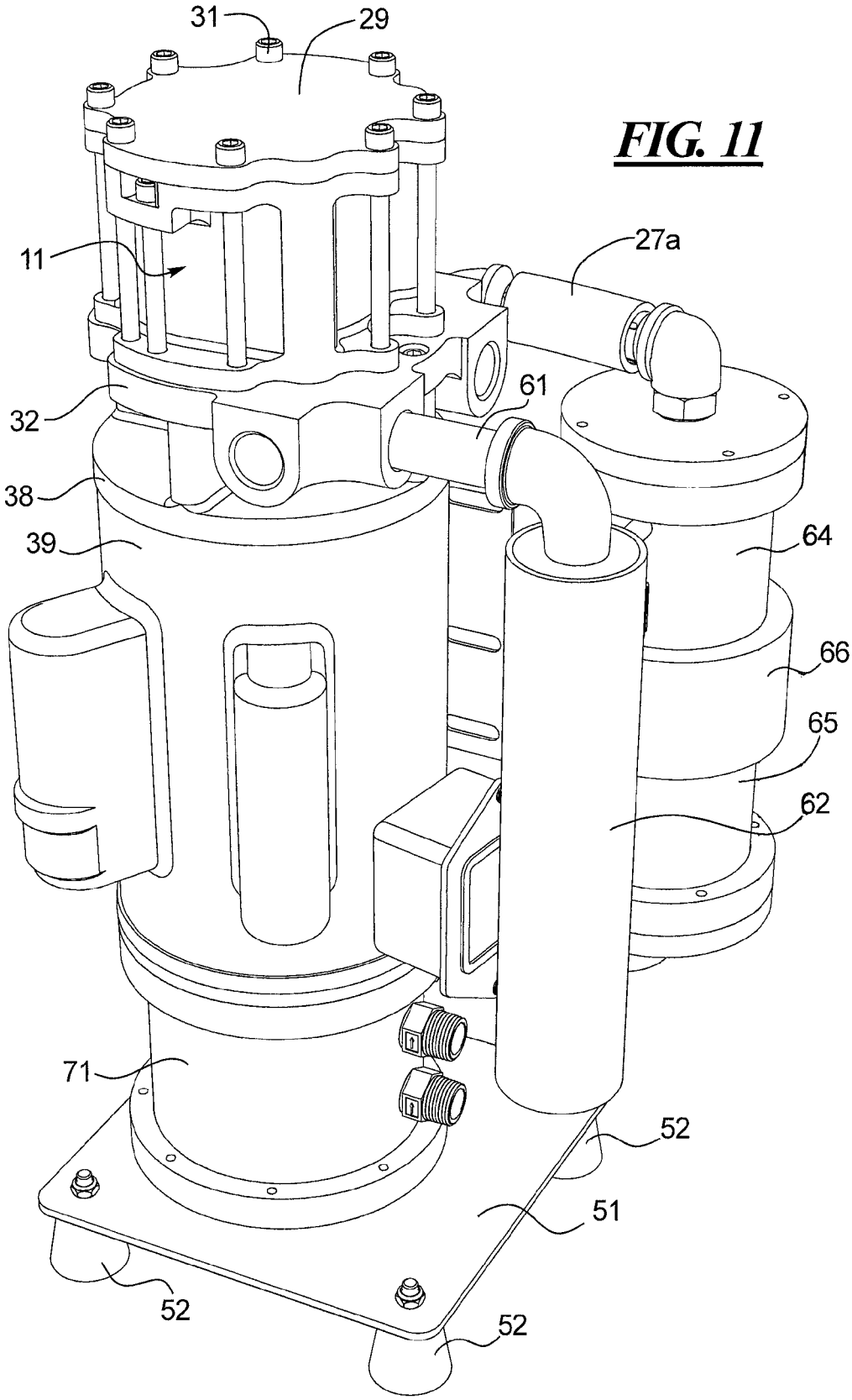
FIG. 11 is another perspective view of the apparatus shown in FIG. 10.
Figure 12:
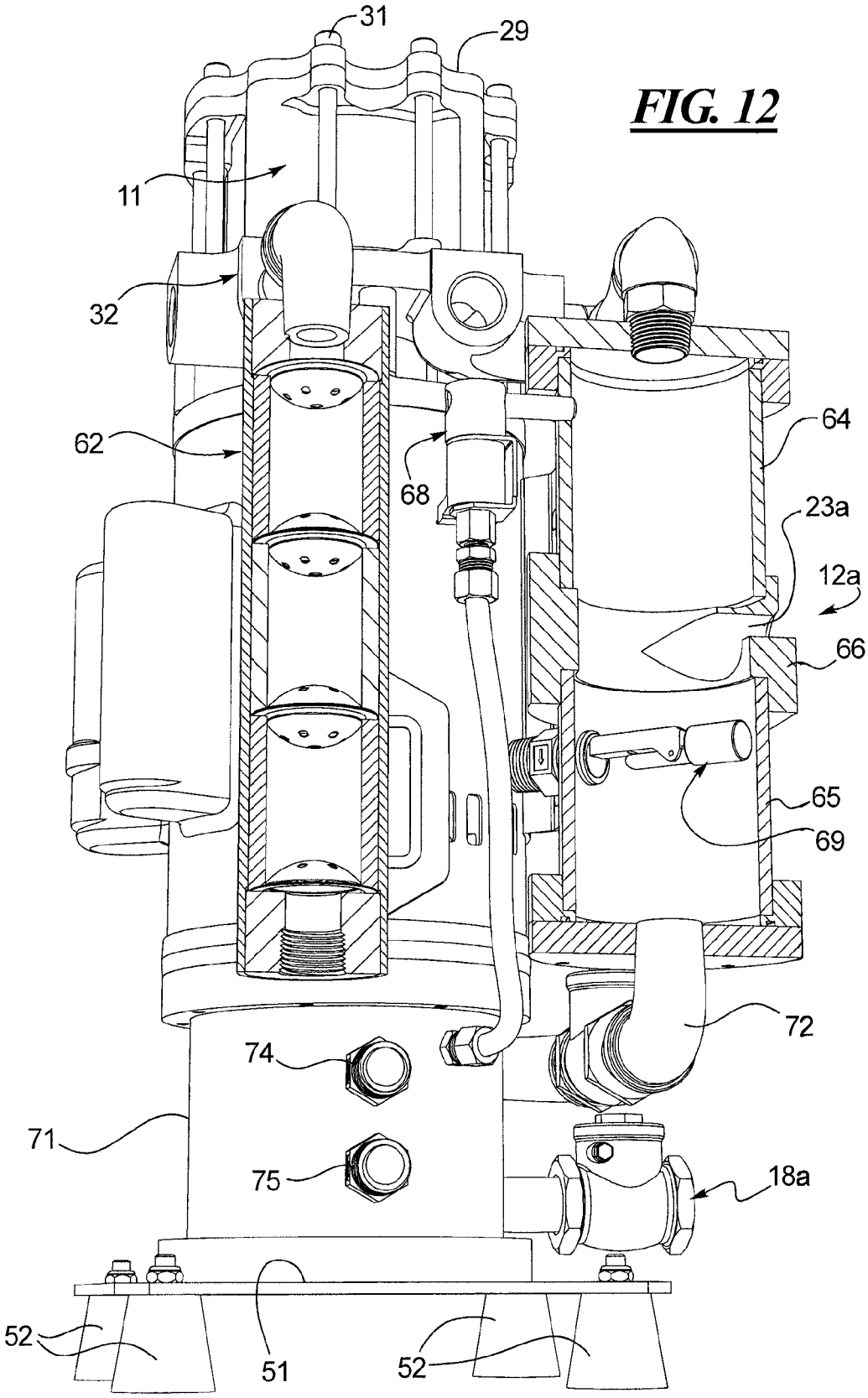
FIG. 12 is a partial sectional view of the apparatus shown in FIGS. 10-11.

FIGS. 10-12 illustrated a modified apparatus 10*a* that includes a rotary vane pump 11 and head plate 32 disposed between the pump 11 and the motor housing 39. The pump outlet 21 is connected to an exhaust tubing 24 which, in turn, is connected to a muffler 62. The liquid separation mechanism 12*a* is substantially different than the separator 12 illustrated in FIGS. 2-4 and 7.

The liquid separator 12*a* includes an inlet 23*a* disposed between upper and lower chambers 64, 65. A flapper valve or baffle 69 is disposed in the collar 66 that forms the inlet 23*a* or just below the collar 66 in the lower chamber 65 as illustrated in FIG. 12. A solenoid valve 68 or other suitable valve is connected to the upper chamber 64 as best seen in FIG. 12. The lower chamber 65 is connected to a bottom reservoir 71 by the conduit 72. The bottom reservoir 71 includes an upper level switch 74 and a lower level switch 75.

In operation, the rotary vane pump 11 runs continuously and therefore the upper chamber 64 is under vacuum. With the solenoid 68 in a closed position, thereby isolating the upper chamber 64 from the atmosphere and equalizing the pressures in the upper and lower chambers 64, 65, air/fluids/solids will enter the upper chamber 64 through the inlet 23*a* and the fluids/solids will drain downward to the lower chamber 65 under the force of gravity. Material will pass downward through the conduit 72 into the bottom reservoir 71. When the upper level switch 74 of the bottom reservoir 71 is activated, the system needs to be drained and the solenoid 68 is opened thereby creating pressure in the upper chamber 64 and closing the flapper valve 69. With the lower chamber 65 and bottom reservoir 71 isolated from the vacuum of the rotary vane pump 11, material may exit the system through the check valve 18*a* under the force of gravity. As the level of liquid in the bottom reservoir 71 approaches the lower level switch 75, the solenoid 68 is closed, the pressures in the chamber 64, 65 are equalized, and the flapper or baffle 69 is opened for normal draining between the upper chamber 64 and lower chamber 65.

While only certain embodiments have been set forth, alternatives and modifications will be apparent from the above description to those skilled in the art. These and other alternatives are considered equivalents and within the spirit and scope of this disclosure and the appended claims.

What is claimed:

1. A compact combination suction and separation apparatus, comprising:

a pump comprising a suction inlet and an exhaust outlet;

a liquid separator comprising a separator inlet configured to receive air, liquids and solids, an air discharge in communication with the suction inlet of the pump, and a liquids/solids discharge configured to drain liquids and solids from the liquid separator; and a motor disposed between and coupled to the pump and separator.

2. The apparatus of claim 1 further comprising a noise-reducing enclosure.

3. The apparatus of claim 1 wherein the pump is disposed at an upper portion of the apparatus.

4. The apparatus of claim 1 wherein the pump is a vertically oriented rotary vane pump.

5. The apparatus of claim 4 wherein the rotary vane pump comprises a cantilevered rotor.

6. The apparatus of claim 4 wherein the rotary vane pump comprises a casing disposed between an upper cap and a head plate, the casing accommodating a pump rotor and a plurality of vanes slidably coupled to the pump rotor, the pump rotor being coupled to the motor by a drive shaft that vertically passes upward through the head plate, and the upper cap is removably coupled to the casing with a plurality of fasteners to allow access to the rotor and vanes.

7. The apparatus of claim 1 wherein the air discharge is coupled to the suction inlet by tubing.

8. The apparatus of claim 1 wherein the liquid separator comprises a separator rotor coupled to the motor by a drive shaft extending vertically downward from the motor.

9. The apparatus of claim 1 wherein the motor is coupled to a drive shaft that extends vertically upward to the pump and vertically downward to the liquid separator, the liquid separator comprises a separator rotor coupled to a lower portion of the drive shaft and the pump comprising a pump rotor coupled to an upper portion the drive shaft.

10. The apparatus of claim 9 wherein the rotary vane pump comprises a casing disposed between an upper cap and a head plate, the casing accommodating the pump rotor and a plurality of vanes slidably coupled to the pump rotor, the pump rotor is coaxially coupled to the drive shaft, an upper portion of the drive shaft and rotor being disposed within the pump casing and being offset from an axial center of the pump casing, and the vanes slidably coupled to the pump rotor extending radially outwardly from the drive shaft and pump rotor when the pump rotor is rotated within the casing.

11. A compact combination suction and liquid separation apparatus, comprising:

a rotary vane pump comprising a pump casing with a removable upper cap, a suction inlet and an exhaust outlet;

a separator comprising an inlet for receiving air, liquids and solids from a medical suction tool, the inlet disposed between upper and lower chambers, the separator further comprising a flapper valve separating the upper and lower chambers, the lower chamber being connected to a bottom reservoir, the upper chamber comprising a vent valve for exposing the upper chamber to the atmosphere and the bottom reservoir comprising an upper level indicator for indicating when the bottom reservoir is full and a discharge outlet including a check valve, the upper chamber further comprising an air discharge connected to the suction inlet of the pump, the upper level indicator and vent valve being linked so the vent valve is opened when the upper level indicator in the reservoir is activated by the presence of accumulated liquid and solids.

12. The apparatus of claim 11 wherein the vent valve is a solenoid valve.

13. The apparatus of claim 11 wherein the upper level indicator is an upper level switch and the bottom reservoir further includes a lower level switch that is linked to the vent valve for closing the vent valve when the level in the bottom reservoir reaches the lower level switch.

14. The apparatus of claim 11 further comprising a noise-reducing enclosure.

15. The apparatus of claim 11 wherein the pump is a vertically oriented rotary vane pump with a cantilevered rotor.

16. The apparatus of claim 15 wherein the casing of the rotary vane pump is disposed between the upper cap and a head plate, the suction inlet and pump exhaust passing through the head plate, the casing accommodating a pump rotor and a plurality of vanes slidably coupled to the pump rotor, the pump rotor being coupled to the motor by a drive shaft that vertically passes upward through the head plate into the pump casing, and the upper cap being removably coupled to the casing with a plurality of fasteners to allow access to the rotor and vanes.

17. The apparatus of claim 11 wherein the air discharge is coupled to the suction inlet by tubing.

18. The apparatus of claim 11 wherein the rotary vane pump comprises a casing disposed between the upper cap and a head plate, the casing accommodating the pump rotor and a plurality of vanes slidably coupled to the pump rotor, the pump rotor is coaxially coupled to the drive shaft, an upper portion of the drive shaft and rotor disposed within the pump casing being offset from an axial center of the pump casing, and the vanes being slidably coupled to the pump rotor and extending radially outwardly from the drive shaft and pump rotor when the pump rotor is rotated within the casing.

19. A compact combination suction and separation apparatus for use with dental procedures, comprising:

a vertically oriented rotary vane pump comprising a pump casing disposed between a removable upper cap and a lower head plate, the head plate comprising a suction inlet and an exhaust outlet in communication with the pump casing, the pump further comprising a pump rotor slidably coupled to a plurality of vanes;

a liquid separator comprising a housing and a separator rotor, the separator housing being coupled to an inlet for receiving air, liquids and solids from a dental suction tool, an air discharge coupled to the suction inlet of the pump and a liquids/solids discharge; and a motor disposed between the pump and separator and being coupled to a vertical drive shaft extending upward into the pump casing and being coupled to the pump rotor, the drive shaft also extending downward to the separator housing and being coupled to the separator rotor.

20. The apparatus of claim 19 wherein the pump casing has a vertical axis and the drive shaft, pump rotor, separator rotor and separator housing have a common vertical axis offset from the vertical axis of the pump casing.

* * * * *